United States Patent [19]

Sussman

[11] Patent Number: 4,898,195

[45] Date of Patent: Feb. 6, 1990

[54] SLIDING DRAWER COSMETIC COMPACT

[75] Inventor: Morris Sussman, Freeport, N.Y.

[73] Assignee: Shore Plastics, Inc., Freeport, N.Y.

[21] Appl. No.: 740,477

[22] Filed: Jun. 3, 1985

[51] Int. Cl.[4] ..... A45D 40/00

[52] U.S. Cl. ..... 132/317; 132/218; 206/38; 220/345

[58] Field of Search ..... 132/79 R, 84 R, 79 G; 206/229, 551, 235, 385, 39.6, 815, 823, 38, 345; 229/235; 220/345, 8; 312/348

[56] References Cited

U.S. PATENT DOCUMENTS

| | | | |
|---|---|---|---|
| 2,534,100 | 12/1950 | Baumgartner | 132/84 R |
| 4,433,498 | 2/1984 | Bienz | 40/10 R |
| 4,526,273 | 7/1985 | Tsuji et al. | 132/79 G |

*Primary Examiner*—Joseph Falk
*Assistant Examiner*—J. Hakomaki
*Attorney, Agent, or Firm*—Michael Ebert

[57] ABSTRACT

A travel compact constituted by a rectangular case which houses a sliding drawer having a set of cells therein for storing a small supply of compatibly-colored cosmetics. The drawer is replaceable by another when its supply is exhausted or should the user wish to take along a different set of cosmetics. When the drawer is retracted from the case to expose the cells, detents formed on the side walls of the drawer at the rear end thereof engage a pair of catches which flank the open front end of the case to prevent withdrawal of the drawer. The rear section of one of the side walls is detacted from the bottom wall and from the rear wall of the drawer to form a flexible tine on whose free end is supported one of the detents. When the tine is depressed, this action releases the detent thereon from its catch and makes it possible to withdraw the drawer from the case.

8 Claims, 2 Drawing Sheets

Fig. 1.
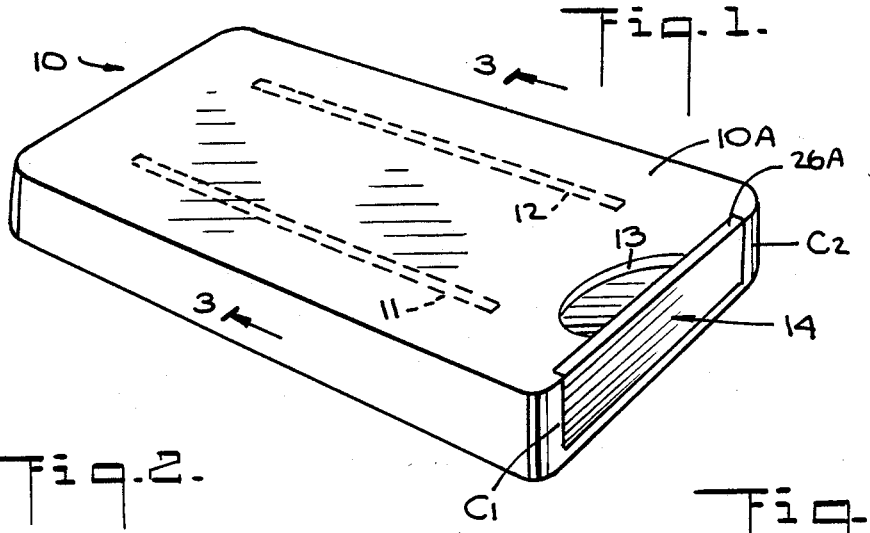
Fig. 2.
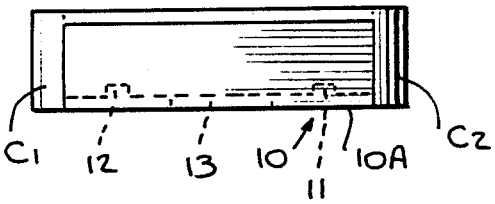
Fig. 3.
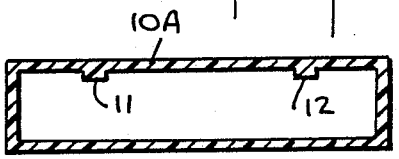
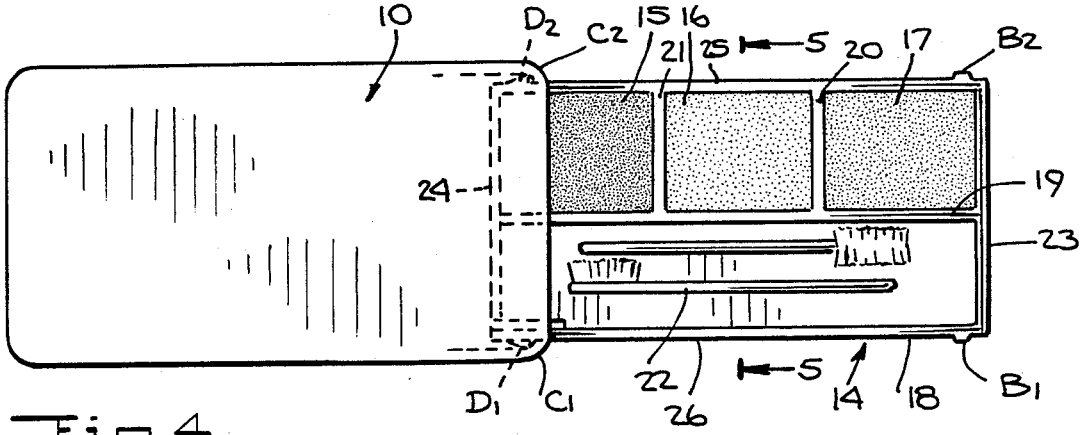
Fig. 4.
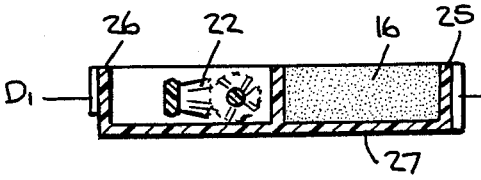
Fig. 5.
Fig. 6.
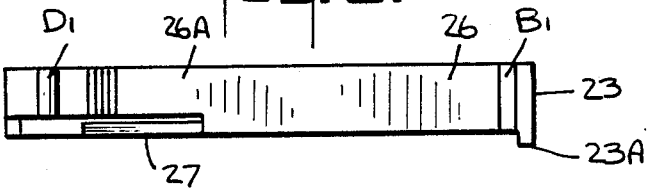

SLIDING DRAWER COSMETIC COMPACT

BACKGROUND OF INVENTION

1. Field of Invention

This invention relates generally to compacts for cosmetics, and more particularly to a travel compact constituted by a case adapted to receive a replaceable sliding drawer having one or more cells for accommodating different cosmetics.

2. Status of Art

In the sense this term is used in the field of cosmetics, make-up encompasses the various cosmetics employed to color and beautify the face. Included, therefore, in make-up are lipstick, blusher, mascara and eye shadow, as well as pressed facial powders. In order to apply these cosmetics, various tools or applicators are required, such as brushes and pencils.

Because of the assortment of cosmetic make-up items available to modern women at home, these items are usually deployed on a mirrored dressing table or are stored in a cosmetics cabinet or shelf. But when away from home, the modern woman only takes along the particular make-up items she needs for the occasion, using her handbag as a carry-all.

This presents a practical problem, for in the typical handbag one finds scattered therein various small compacts, cosmetic containers of various sorts and cosmetic applicators. The same handbag may also contain a handkerchief, a change purse, a wallet and other non-cosmetic items.

While some women take pains to organize the contents of their handbag so as to make the various items therein readily accessible on demand, more typically the items are in a jumble, and when a woman wishes to make up, say, in a restaurant, in a club restroom, or elsewhere away from home, she has difficulty in extracting from her handbag the cosmetic items necessary for make-up. Some women cope with this problem by taking along only a very limited number of basic cosmetic items, but this is not a satisfactory solution; for then the make-up is deficient and the woman may not be at her best.

The particular concern of the invention is with cosmetics that come in complementary colors, such as eyeshadows, lip gloss and blusher. In choosing an eyeshadow color, the modern woman considers not only the time and season at which it will be worn, but also the occasion. Thus for a winter morning, a light blue eyeshadow may be appropriate, whereas a darker blue may be better suited for afternoon wear, while night may call for a gray-black eyeshadow. But should the woman be scheduled to go to a party or attend the theater, then the most effective eyeshadow color for this occasion may be dark green or some other more dramatic color, depending of course on the woman's age, dress, sense of style and other personal variables which come into play in color selection.

After having chosen a specific eyeshadow color, the woman must then select the colors of lip gloss and blusher which complement her eyeshadow choice, for the various cosmetic colors applied to the face must be compatible and harmonious.

While a woman may have available at home a broad assortment of differently colored cosmetics, when away from home she can only find room in her handbag for the limited number of cosmetics in complementary colors required for the particular occasion.

If therefore, for a short trip, the woman's requirements are eyeshadow, lip gloss and blusher in complementary colors and applicators therefor, under existing practice she will place in her handbag an eyeshadow holder, a lip gloss container and a blusher compact as well as the necessary applicators. These separate items will be scattered in the handbag among a variety of others, and when it becomes necessary to make use of the cosmetics, the woman's first problem is to retrieve the required items from the jumble of other items.

Moreover, the amount of cosmetics needed when going, say, to a cocktail party, is relatively small. Conventional cosmetic containers or compacts are fairly bulky and store a supply of cosmetics that is far in excess of that necessary for a short trip. The need exists therefore for a travel compact which provides the user with a relatively small supply of compatibly colored cosmetics sufficient for a given occasion.

SUMMARY OF INVENTION

In view of the foregoing, the main object of this invention is to provide a travel compact having a set of cells therein for storing a small supply of compatibly-colored cosmetics so that the user has available in a single unit that can be placed in her handbag, the set of cosmetics she requires for the occasion.

A significant advantage of the invention is that it does away with the need for several cosmetic compacts and makes it easier for the user to retrieve from her handbag her complementary cosmetic requirements.

More particularly, an object of the invention is to provide a travel compact in the form of a case having a sliding drawer containing a set of cells for storing a small supply of compatibly-colored cosmetics, which drawer is readily replaceable so that the user can take along a drawer having those cosmetics which she requires for the occasion and no others.

Also an object of the invention is to provide a travel compact whose case and whose drawer are both molded of one-piece synthetic plastic material, there being no metal or other components, whereby the compact may be mass-produced at low cost.

Briefly stated, these objects are attained in a travel compact constituted by a rectangular case which houses a sliding drawer having a set of cells therein for storing a small supply of compatibly-colored cosmetics. The drawer is replaceable by another when its supply is exhausted, or should the user wish to take along a different set of cosmetics.

When the drawer is retracted from the case to expose the cells, detents formed on the side walls of the drawer at the rear end thereof engage a pair of catches which flank the open front end of the case to prevent withdrawal of the drawer. The rear sections of one of the side walls is detached from the bottom end of the rear wall of the drawer to form a flexible tine on whose free end is supported one of the detents. When the tine is depressed, this action releases the detent thereon from its catch and makes it possible to withdraw the drawer from the case.

OUTLINE OF DRAWINGS

For a better understanding of the invention as well as other objects and further features thereof, reference is made to the following detailed description to be read in conjunction with the accompanying drawings, wherein:

FIG. 1 is a perspective upside-down view of a travel compact in accordance with the invention, the compact being formed by a case and a sliding drawer;

FIG. 2 shows, right side up, the front end of the case;

FIG. 3 is a transverse section of the case taken in the plane indicated by line 3—3 in FIG. 1;

FIG. 4 shows the travel compact in top view with the sliding drawer thereof fully retracted to expose the cosmetics cells;

FIG. 5 is a transverse section taken in the plane indicated by line 5—5 in FIG. 4;

FIG. 6 is a view of the drawer;

DESCRIPTION OF INVENTION

Figure 7:
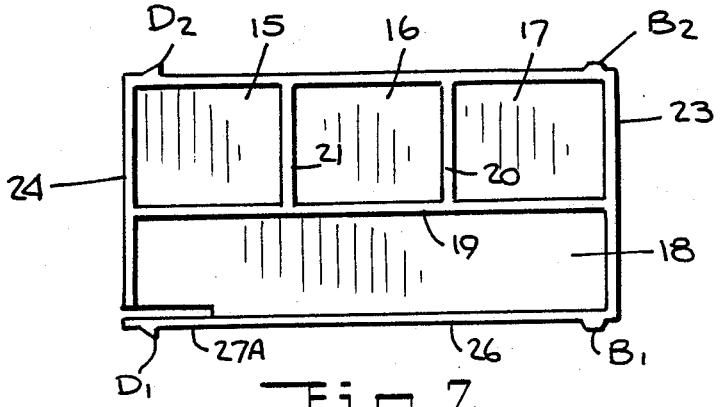
FIG. 7 is a top view of the drawer.

Referring now to FIGS. 1, 2, and 3, there is shown a travel compact in accordance with the invention having a case 10, the case being generally rectangular in form and having an open front end. The bottom wall 10A of the case is provided on its inner surface with parallel rails 11 and 12, the front edge of this wall having at its center a finger notch 13. Received in the case is a sliding drawer 14.

Flanking the open end of the case on either side thereof are curved-in catches $C_1$ and $C_2$. The case is molded of synthetic plastic material of good mechanical strength, such as polyethylene or polyvinyl chloride.

As shown in FIG. 4, When drawer 14 is in its fully retracted position, this exposes a set of three cells 15, 16 and 17 and an applicator compartment 18. These are defined by a longitudinal partition 19 and transverse partitions 20 and 21. Cells 15, 16 and 17 are filled with different cosmetics such as eyeshadow, lip gloss and blusher in complementary colors. Compartment 18 serves to store applicators such as brush 22.

Drawer 14 is provided with a bottom wall 27 and further includes a front wall 23 that is joined to a rear wall 24 by side walls 25 and 26 to define a rectangular frame. The height of the front wall 23 is slightly greater than that of side walls 25 and 26 to form a small ridge 23A, as shown in FIG. 6. This ridge facilitates retraction of the drawer, for the user has only to insert a finger in notch 13 to grasp the ridge. The bottom wall of the drawer is provided with tracks (not shown) which run adjacent rails 11 and 12 of the case to ensure proper sliding movement.

Side wall 26 is joined to front wall 23, but the rear section of this wall is detached from wall 24 and the bottom wall to form a flexible plastic tine 26A. Mounted adjacent the free end of flexible tine 26A is a detent D1 having a sloped step; while mounted at a corresponding position on side wall 25 is a like detent $D_2$. These stepped detents, when the drawer is fully retracted to expose the cosmetic cells, engage catches $C_1$ and $C_2$ to prevent removal of the drawer from the case.

If, however, one wishes to withdraw the drawer from the case to replace the drawer with another drawer, the user has only to depress tine 26A, thereby disengaging detent $D_1$ from catch $C_1$ and making it then possible to remove the drawer. When a new drawer is thereafter inserted in the case, the catches are then engaged by the slope of the detent steps, thereby causing detent $D_1$ on tine 26A to flex inwardly to permit entry of the drawer.

Formed on side wall 26 adjacent the front end wall 23 is a small rounded bump $B_1$, a like bump $B_2$ being formed on side wall 25. These snap-in bumps are pressed in by catches $C_1$ and $C_2$ when the drawer is fully inserted and lie behind the catches to resist retraction of the drawer.

Thus the user has available in a single compact three small supply cells containing cosmetics in complementary colors. And when the cosmetics are exhausted, or when there is a need for another set of complementary cosmetic colors, the drawer may be replaced to satisfy the user's requirements.

Figure 9:
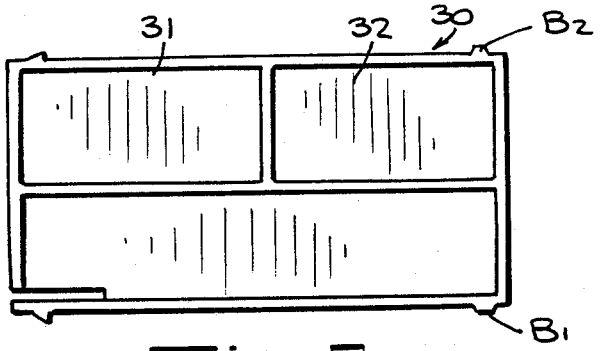
FIG. 9 is a top view of a third embodiment of the sliding drawer.
Figure 8:
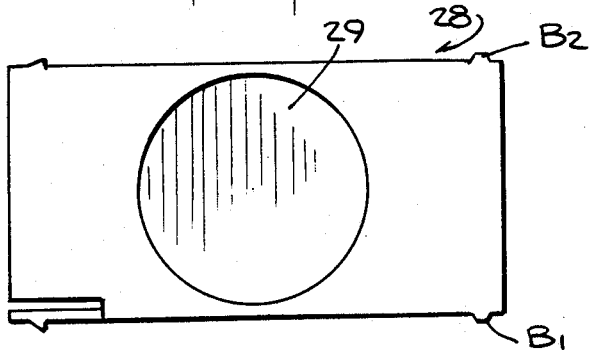
FIG. 8 is a top view of the second embodiment of the sliding drawer.

The invention is not limited to a three cell drawer, for as shown in FIG. 8, the drawer 28 may be provided with a single, relatively large cosmetic cell 29, the drawer being otherwise the same as drawer 14 in the first embodiment. Or as shown in FIG. 9, the drawer 30 may have two cosmetic cells 31 and 32 and an applicator compartment 32.

In practice, the user may be provided with a substantial number of drawers each containing a different set of cosmetics in complementary colors, so that when the occasion for travel arises, she can choose that drawer for her trip which contains her choice and then insert the selected drawer in the case. The drawers may be packaged in sealed boxes which identify their contents so that the user may store a large supply thereof.

While there has ben shown and described a preferred embodiment of SLIDING DRAWER COSMETIC COMPACT in accordance with the invention, it will be appreciated that many changes and modifications may be made therein without, however, departing from the essential spirit thereof.

I claim:

1. A travel cosmetic compact comprising:

A a molded plastic rectangular case having an open front end which is flanked by a pair of side catches;

B a molded plastic drawer slidable in said case and having at least one cell for containing a cosmetic supply, said drawer being provided with a bottom wall, front and rear walls and side walls, to define a rectangular frame, one of said side walls having a rear section which is detached from the bottom wall and the rear wall to define a flexible tine; and C a pair of detents, one of which is formed on the free end of the tine, the other being formed at a corresponding position on the second side wall, said detents being adapted to engage the side catches of the case when the drawer is fully retracted to expose the cell and to prevent withdrawal of the drawer, said tine when the drawer is fully retracted at which position the tine is partially exposed being depressible to effect disengagement of the detent thereon from the side catch engaged thereby whereby the drawer may then be withdrawn from the case and replaced by another drawer.

2. A travel cosmetic compact as set forth in claim 1, wherein said compact is provided with three cells to contain different cosmetics in complementary colors.

3. A travel compact as set forth in claim 1, wherein said front wall is provided with a ridge which projects below the side walls to facilitate retraction of the drawer, the case having a bottom wall provided with a finger notch which is adjacent said ridge when the drawer is fully inserted.

4. A travel compact as set forth in claim 1, wherein said frame is divided by partitions into three cells for receiving cosmetics and a compartment for storing cosmetic applicators.

5. A travel compact as set forth in claim 1, wherein said catches have a curved-in form and said detents have a sloped step formation.

6. A travel compact as set forth in claim 1, wherein said auxiliary side wall and said second side wall each have a snap-in bump thereon adjacent the front wall to engage said catches.

7. A travel compact as set forth in claim 1, wherein said drawer includes a compartment for storing applicators.

8. A travel compact as set forth in claim 1, wherein said case has a bottom wall which is provided with at least one longitudinally-extending raised rail to engage a track in the bottom wall of the drawer to ensure proper sliding movement of the drawer.

* * * * *